US005230737A

United States Patent [19]

Takada et al.

[11] Patent Number: 5,230,737

[45] Date of Patent: Jul. 27, 1993

[54] WALLPAPER PASTING APPARATUS

[75] Inventors: Toshinari Takada; Yusuke Yokota, both of Hyogo; Arata Koroyasu, Tatsuno; Yasuaki Matsui, Kakogawa, all of Japan

[73] Assignee: Kyokutosanki Co., Ltd., Hyogo, Japan

[21] Appl. No.: 701,537

[22] Filed: May 1, 1991

[30] Foreign Application Priority Data

May 2, 1990 [JP] Japan ..... 2-47277[U]

[51] Int. Cl.[5] ..... B05C 11/04

[52] U.S. Cl. ..... 118/102; 118/123; 118/235; 118/246; 118/258

[58] Field of Search ..... 118/DIG. 17, 102, 204, 118/235, 246, 258, 123, 419, 428, 429

[56] References Cited

U.S. PATENT DOCUMENTS 1,131,685 3/1915 Dunn et al. ..... 118/DIG. 17
2,264,501 12/1941 Beach ..... 118/DIG. 17
4,524,714 6/1985 Hohenhövel ..... 118/123

FOREIGN PATENT DOCUMENTS 3-34872 4/1991 Japan .
603149 6/1948 United Kingdom ..... 118/123
2034203 6/1980 United Kingdom ..... 118/123

*Primary Examiner*—W. Gary Jones
*Assistant Examiner*—Todd J. Burns
*Attorney, Agent, or Firm*—Armstrong, Westerman, Hattori, McLeland & Naughton

[57] ABSTRACT

The wallpaper pasting apparatus characterized in that the wallpaper pasting apparatus is provided with a pasting roller and a pressing guide for pressing the wallpaper against the upper surface thereof, by a plurality of levelling plate means having edge wavy grooves for adjusting the thickness of the paste layer transferred onto the wallpaper.

This apparatus has a simple structure and a light weight, and permits easy and accurate adjustment of the thickness of the paste layer.

11 Claims, 9 Drawing Sheets

WALLPAPER PASTING APPARATUS

FIELD OF THE INVENTION

The present invention relates to a wallpaper pasting apparatus. More particularly, the present invention relates to a manually operatable wallpaper pasting apparatus which permits easy adjustment of the thickness of the paste layer and consists of a simple structure.

PRIOR ART

A manual wallpaper pasting apparatus is conventionally known which is simply applicable at a construction site. This conventional wallpaper pasting apparatus as shown in FIG. 11, is based on a method comprising dipping the lower portion of a pasting roller (101) bearing-supported on a base into paste contained in a paste container (102) and transferring paste (104) onto wallpaper (103) while rotating said pasting roller (101). For the purpose of adjusting the amount of deposition of paste in this transfer, the amount of paste is controlled with the use of a doctor roller (105) or a doctor knife, an alternative thereof, in which the gap from the pasting roller (101) is made freely adjustable.

Although this conventional pasting apparatus has favorable features as a relatively simple and easy manual apparatus, it still has several points to be improved.

According to a pasting apparatus illustrated in FIG. 11 as a typical conventional pasting apparatus, use of a doctor roller (105) requires a complicated gear mechanism for causing rotation of the doctor roller (105), thus not only resulting in an increased weight of the pasting apparatus, but also making it difficult to improve the accuracy for adjusting the gap between the pasting roller (101) and the doctor roller (105), as in the case of the doctor knife. In addition, maintenance for the gear mechanism may be troublesome.

These drawbacks are not desirable also because a pasting apparatus is to be used at a construction site, and such drawbacks should be solved as soon as possible.

With a view to solving these problems, the present inventors have already proposed a new manual wallpaper pasting apparatus. In the case of this pasting apparatus, as shown in FIG. 1 for example, a base (3) having a paste container (2) is supported by a foldable supporting leg (1); a pasting roller (5) is pivot-attached in the paste container (2) so that the lower portion of the roller may be dipped into paste (4) in the paste container (2); and pressing guides (*7a*) and (*7b*) for pressing wallpaper (6) against the upper surface of the pasting roller (5) are arranged on the upper portion of the pasting roller (5). Paste (4) is deposited and transferred onto the wallpaper (6) along with the rotation of the pasting roller (5).

The thickness of the paste layer, depending upon the concentration of paste, may usually reach approximately 1 mm, but this paste layer thickness must be adjusted in the range of about 0.1 mm. In this pasting apparatus, therefore, a levelling means with a curved surface such as a levelling roller (8) is provided on the rear portion of the pasting roller (5) so as to adjust the paste layer thickness by scraping off a prescribed amount of paste (4) adhering to the wallpaper (6). In addition, for the purpose of accomplishing this adjustment accurately, the wallpaper (6) is pressed by means of the pressing guide (*7b*), and at the same time, a drawing guide (9) is provided on the rear portion of the levelling roller (8) to keep a constant contact pressure between the levelling roller (8) and the wallpaper (6).

By controlling the pressing force of the pressing guide (*7b*) against the wallpaper (6) through the arrangements as described above, it is possible to adjust the contact pressure between the wallpaper (6) and the levelling roller (8) and to adjust the paste layer thickness. Furthermore, because the presence of the drawing guide (9) acting as the guide for manually drawing out the wallpaper (6) keeps a constant contact pressure, the paste layer thickness becomes constant in the longitudinal direction of the wallpaper.

With a view to adjusting the contact pressure of the wallpaper (6) with the levelling roller (8) through positional control of the pressing guide (*7b*) in the vertical shift thereof, the contact pressure can be adjusted by selecting an insertion/engagement position of a pressing adjustment pin (12) fixed to the base (3) into one of a plurality of pin grooves (11) provided at the end of a cover (10) equipped with the pressing guides (*7a*) and (*7b*). The cover (10) can be opened and closed in the arrow (A) direction in the drawing.

The insertion/engagement position of the pressing adjustment pin (12) is altered by moving forward or backward handle (13) in the arrow (B) direction in the drawing, for example. When the pressing adjustment pin (12) is inserted/engaged in a lower pin groove (11), the pressing force of the pressing guide (*7b*) becomes smaller, and the contact pressure of the wallpaper (6) against the levelling roller (8) also becomes smaller, thus reducing the amount of scraped paste (4). When the pin (12) is inserted/engaged into an upper groove, the amount of scraped paste becomes larger in contrast.

The contact pressure between the wallpaper (6) and the levelling roller (8) and the paste layer thickness may be adjusted, by making it possible for the levelling roller (8) to move vertically, through control of the moving range thereof, in addition to the adjustment of the paste layer thickness through control of the pressing force by the pressing guide (*7b*).

While the above-mentioned manual pasting apparatus was far superior to the conventional ones in accuracy for adjusting the paste layer thickness as well as in operating convenience, the subsequent review revealed several points still to be improved.

In the above-mentioned pasting apparatus, for example, it is possible to adjust the contact pressure between the wallpaper (6) and the levelling roller (8) and the paste layer thickness through control of the pressing force of the pressing guide (*7b*) against the wallpaper (6). While this poses no problem when the operator is skilled in the art and the drawing speed of manually drawing out the wallpaper (6) is almost constant, it is difficult to keep a constant drawing speed when there are multiple operators or the operator is not skilled, and if the difference is large, variations in the contact pressure caused by frictional resistance (viscosity resistance) between the levelling roller (8) and paste adhering to the wallpaper (6) cannot be disregarded. For this reason, large variations in the contact pressure cause irregularities in the paste layer.

Another drawback is that the difference in viscosity resulting from the concentration of paste (difference in resistance coefficient and difference in liquid density) leads to a large difference in the amount of deposited paste.

SUMMARY OF THE INVENTION

An object of the present invention is therefore to provide a novel wallpaper pasting apparatus which permits improvement of the drawbacks, while utilizing the favorable merits of the so far proposed pasting apparatus described above, has a simple structure with a light weight, and allows easy and accurate adjustment of the paste layer thickness.

The wallpaper pasting apparatus of the present invention is characterized by comprising, in a wallpaper pasting apparatus equipped with a pasting roller and a pressing guide for pressing the wallpaper against the upper surface thereof, a levelling plate having edge wavy grooves for adjusting the thickness of the paste layer transferred onto the wallpaper.

DETAILED DESCRIPTION OF THE INVENTION

Figure 1:
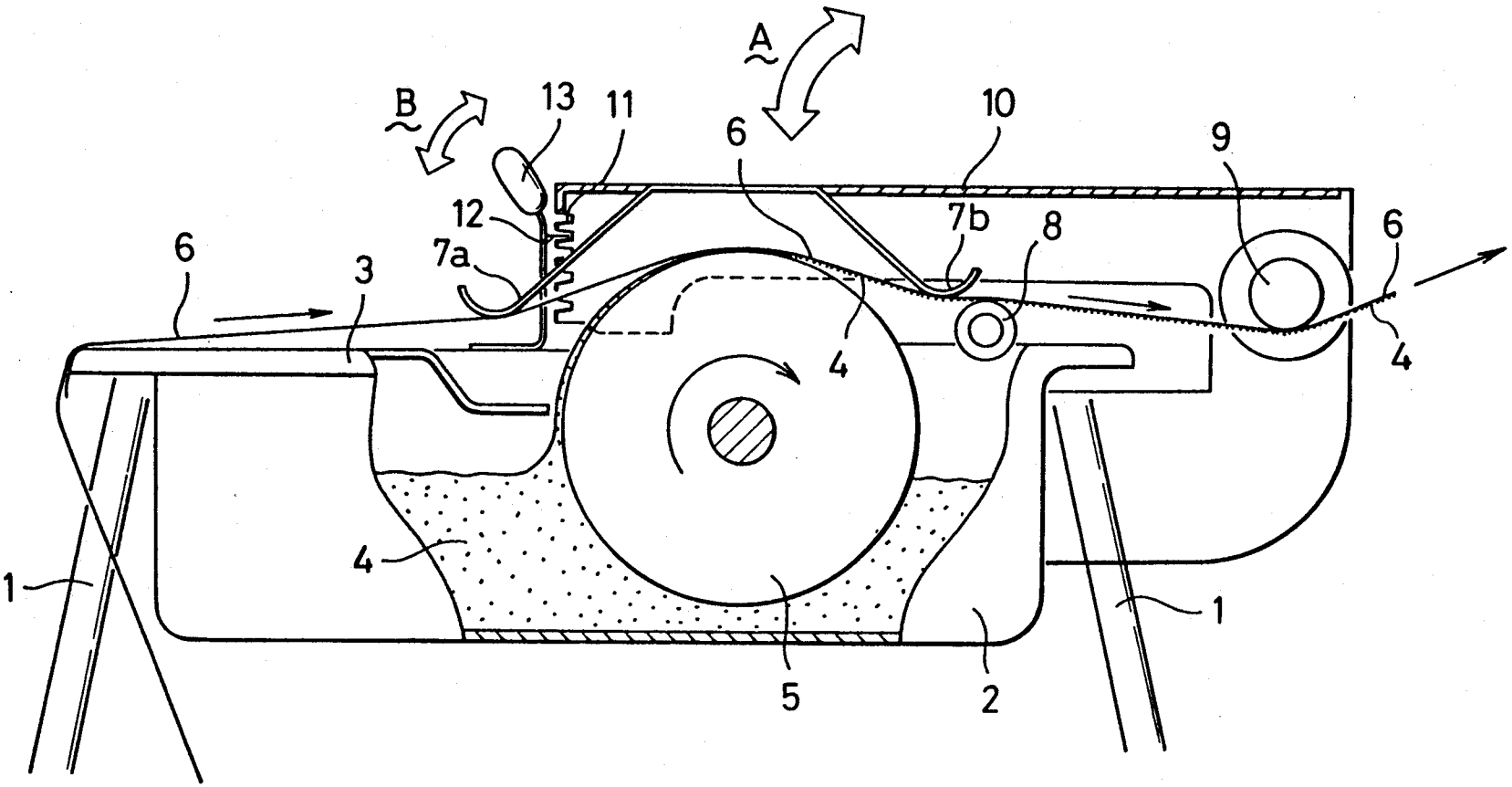
FIG. 1 is a partially cutaway side view illustrating the already proposed pasting apparatus.
Figure 2:
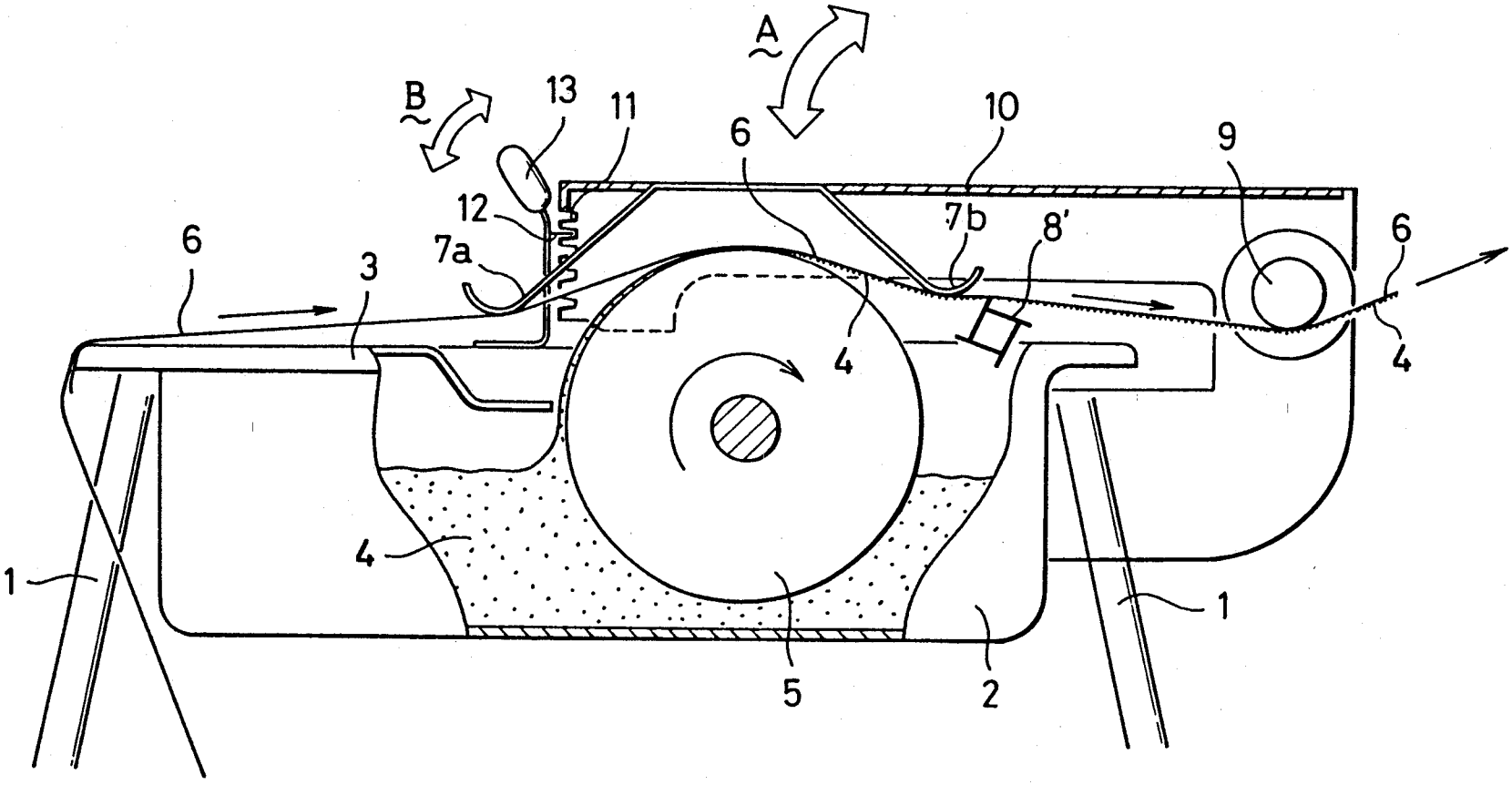
FIG. 2 is a partially cutaway side view illustrating an embodiment of the present invention corresponding to FIG. 1.

In the present invention, as shown in FIG. 2, a levelling plate (8') having edge wavy grooves is provided as a replacement for the curved surface leveling means in the construction of the pasting apparatus shown in FIG. 1.

Figure 3:
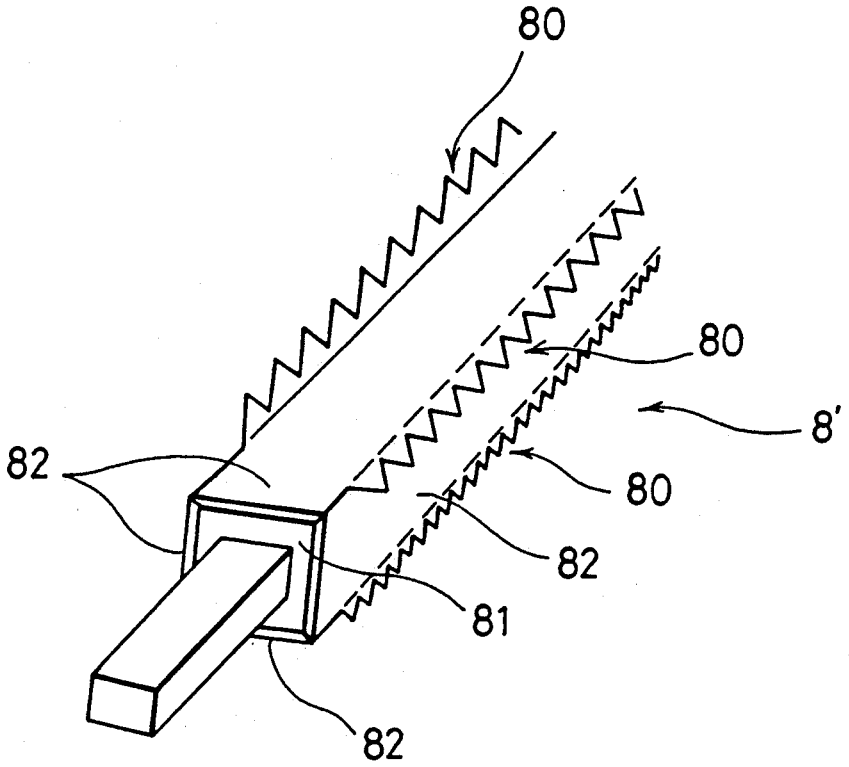
FIG. 3 is a perspective view illustrating a typical levelling plate.

The levelling plate (8') may have an appearance as shown in FIG. 3, for example. More particularly, the levelling plate (8') has saw teeth-shaped wavy grooves (80) along the edge in contact with the wallpaper (6). Also as shown in this example, a plate (82) having edge wavy grooves (80) may be attached to a bar-shaped square member (81).

Figure 4:
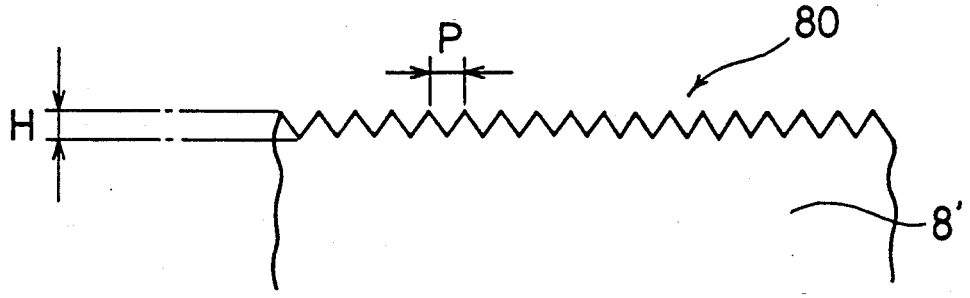
FIG. 4 (*a*), (*b*) and (*c*) are front views illustrating examples of wavy grooves of the levelling plate, respectively.
Figure 4:
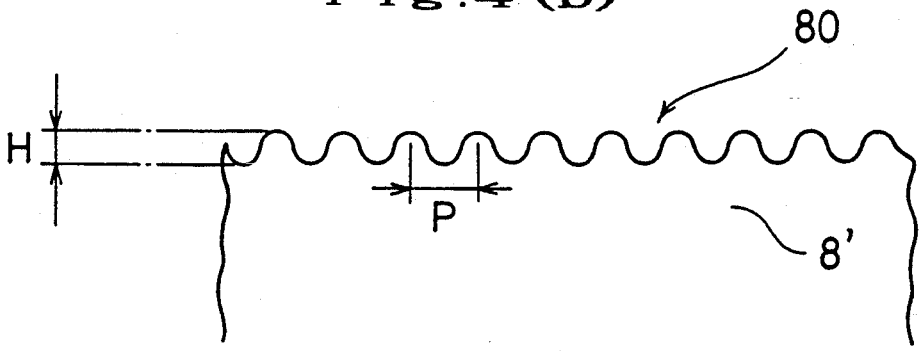
Figure 4:
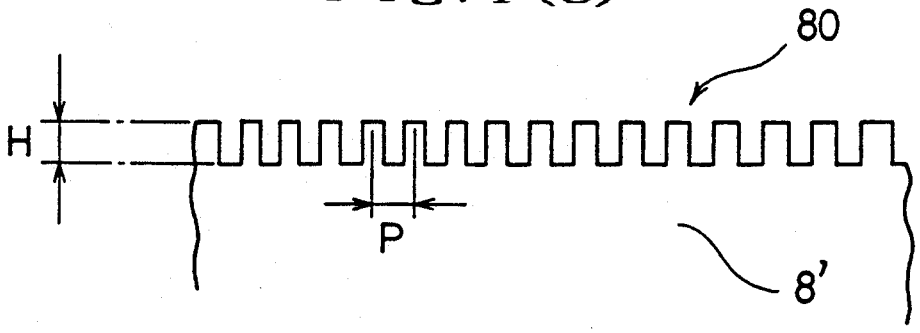

Any of various shapes may appropriately be adopted for the wavy grooves (80), as shown, for example, in FIGS. 4 (*a*), (*b*) and (*c*). The shape of the wavy grooves, and the groove depth (H) and pitch (P), respectively, may be determined in accordance with the manner of application of the pasting apparatus.

Although the use of such levelling plate (8') as having wavy grooves (80) may be considered to make it difficult to adjust the thickness of the deposited paste layer, actually, the use of this levelling plate (8') having wavy grooves (80) facilitates adjustment, and makes it possible to accomplish pasting in a uniform thickness almost without being affected by the difference in the drawing speed of the wallpaper (6).

Figure 5:
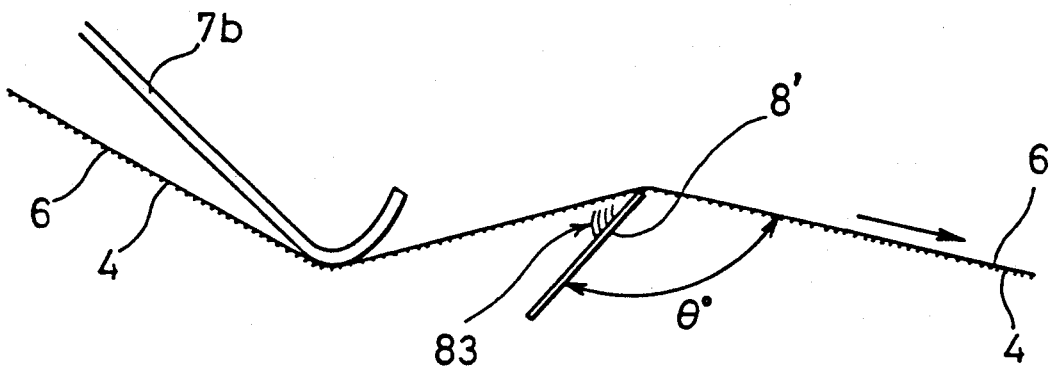
FIG. 5 is a side view illustrating the installation angle of the levelling plate.

In this case, the arangement of the contact angle ($\theta$) between the levelling plate (8') and the wallpaper (6) as shown in FIG. 5, is not so important to control the thickness of the deposited paste layer. But, the angle ($\theta$) of more than 135° makes it imposible to adjust the pasting because of a paste accumulation (83) in the upstream of the levelling plate (8'), and the angle ($\theta$) of less than 45°, on the other hand, makes it more difficult to accomplish the adjustment by means of the levelling plate (8') having wavy grooves (80). Accordingly, in the present invention, the contact angle ($\theta$) is selected within the range of 45° to 135°.

Figure 6:
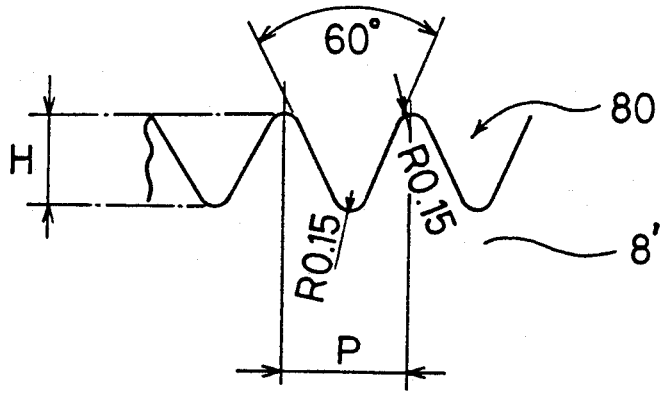
FIG. 6 is a front view illustrating an example of wavy grooves.

In fact, when employing, for example, a levelling plate (8') having wavy grooves (80) the tips of which are slightly rounded as shown in FIG. 6, an average amount of applied paste is determined by the extent of the pitch (P), irrespective of the angle of installation ($\theta$). The following Table 1 shows, for the case where levelling plates (8') with four different pitches were stuck to bar-shaped square members (81) as shown in FIG. 3 and paste having a paste/water ratio of 1.5:1 (in weight) was applied, the average amount of applied paste per 1 $m^2$.

Since the actual amount of applied paste is within a range of from 130 to 200 $g/m^2$, any case can be coped with by using such groove pitches (P) as shown in Table 1, and furthermore, this can easily be adjusted by altering the extent of the pitch (P).

TABLE 1

| Groove pitch (P) | Average amount of applied paste per 1 $m^2$ |
|---|---|
| 1.3 | 215 $g/m^2$ |
| 1.1 | 165 $g/m^2$ |
| 0.9 | 145 $g/m^2$ |
| 0.8 | 132 $g/m^2$ |

It is possible, as described above, by the use of the levelling plate (8'), to inhibit deposition irregularities of paste caused by the drawing speed of wallpaper or viscosity of the paste.

Figure 7:
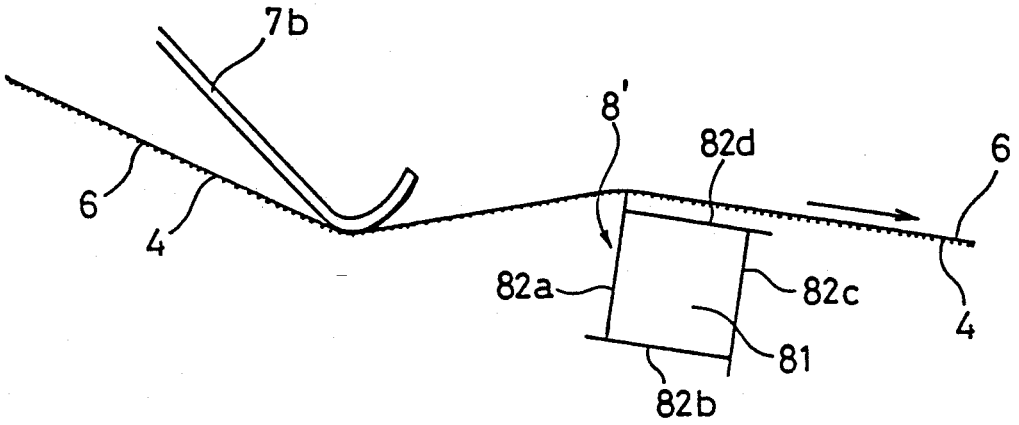
FIGS. 7 (*a*), (*b*) and (*c*) are side views illustrating examples of the levelling plate, respectively.
Figure 7:
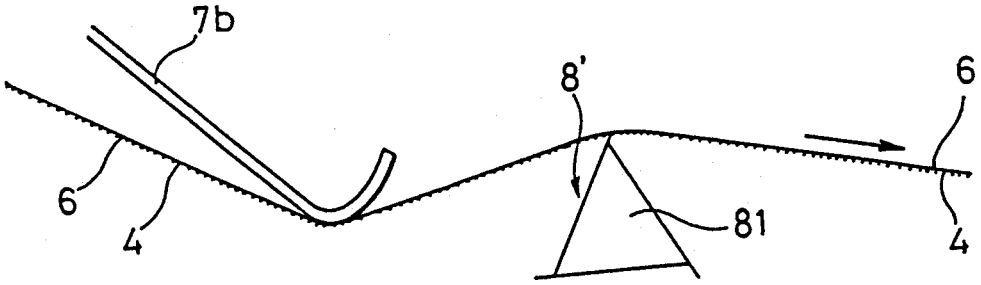
Figure 7:
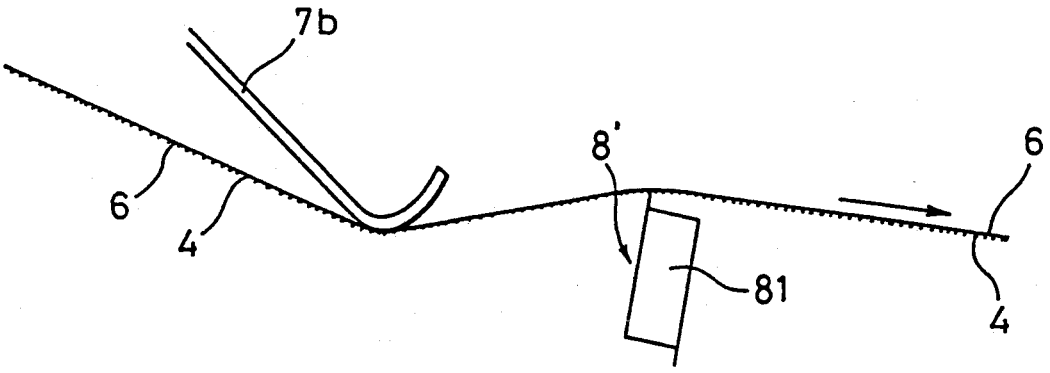

The levelling plate (8') in the present invention may easily be implemented by attaching a plate having wavy grooves (80) to an appropriate bar-shaped square member (81). The square member (81) may have any sectional shape as shown, for example, in FIGS. 7(*a*), (*b*) and (*c*). In this case, if plates (82) having wavy grooves which are different in groove shape and pitch, for example, having four kinds (82*a*), (82*b*), (82*c*) and (82*d*) as shown in FIG. 7(*a*) are attached to the square member (81) so as to allow the square member (81) to rotate, adjustment of the amount of applied paste is easier.

It is not of course necessary to attach a plurality of plates.

The square member (81) may be made vertically movable.

Figure 8:
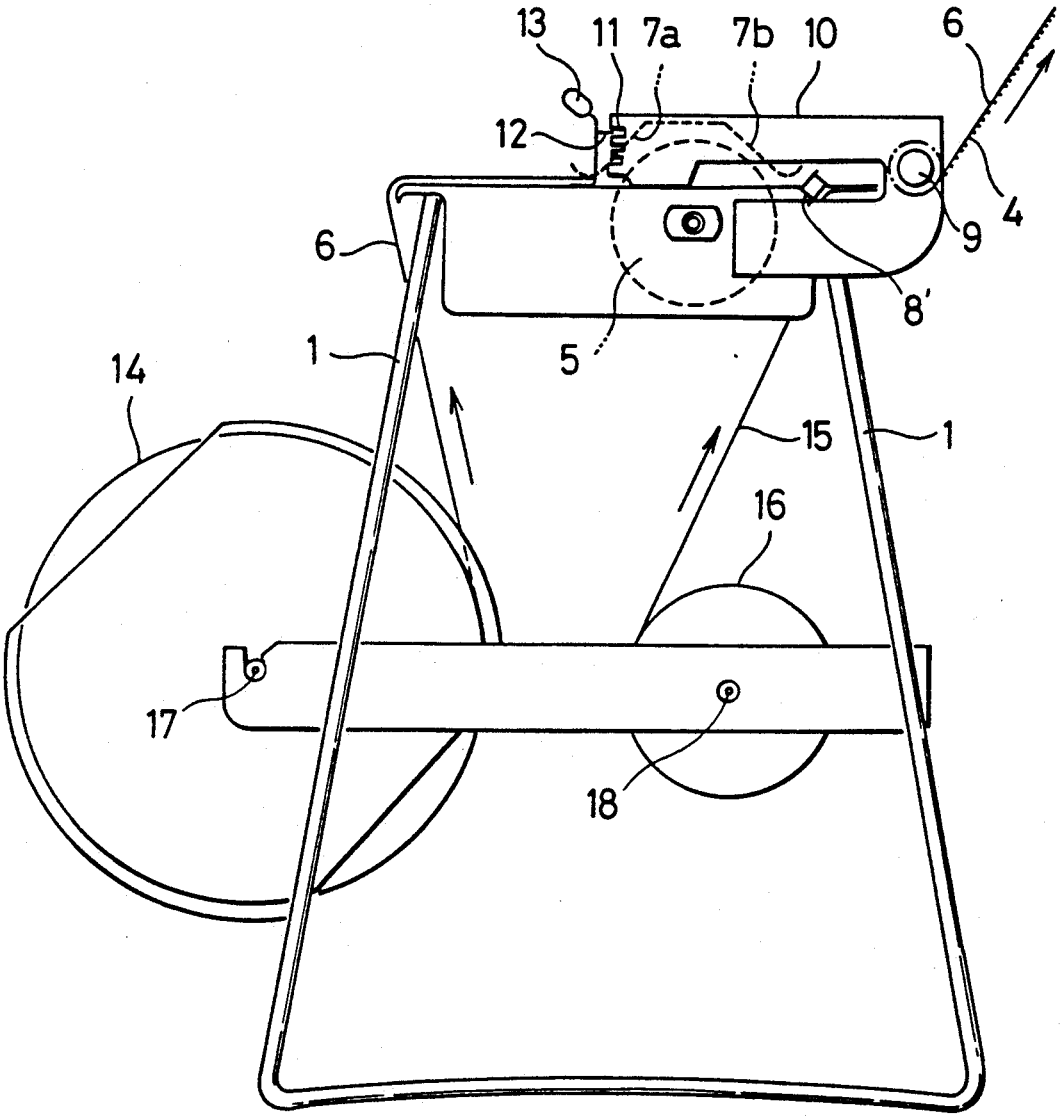
FIG. 8 is side view illustrating an example of the exterior view of the pasting apparatus of the present invention.
Figure 9:
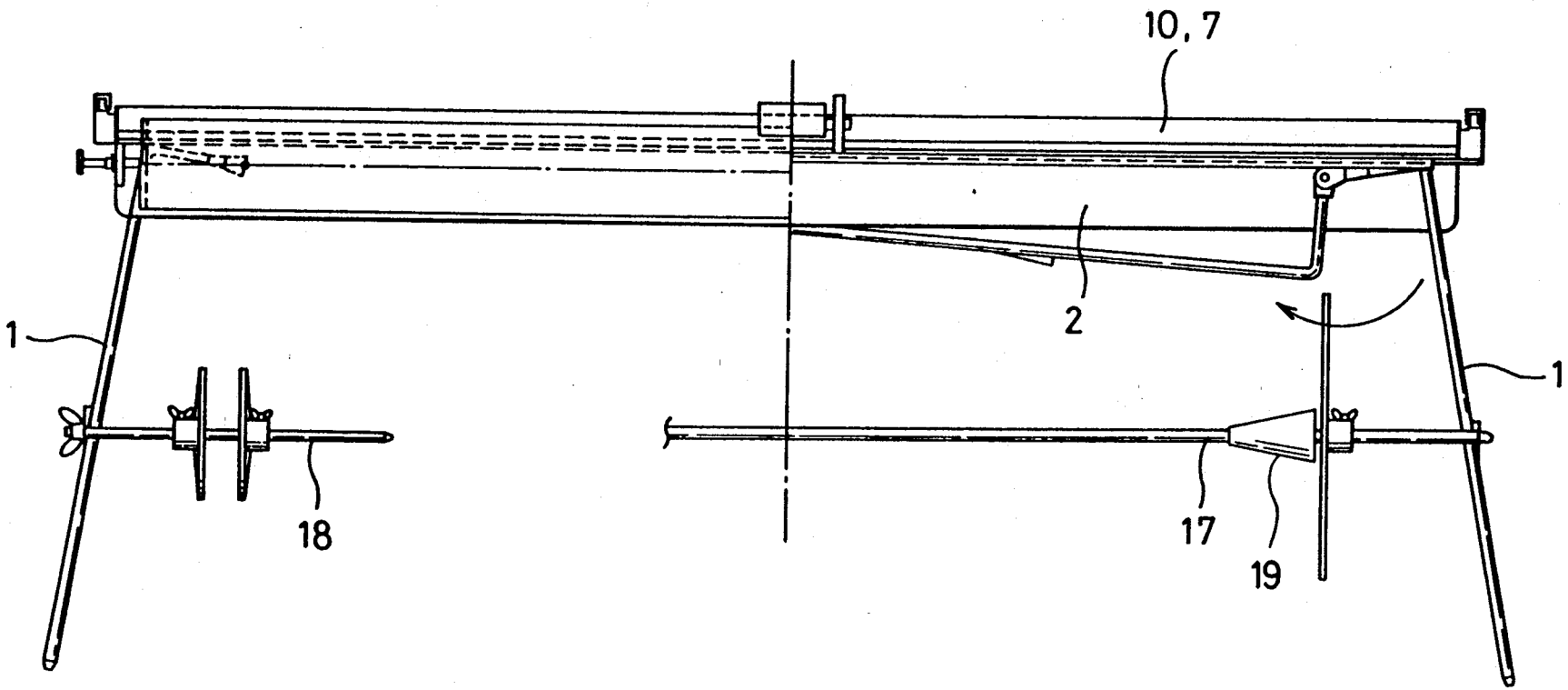
FIG. 9 is front and back views illustrating the example of the pasting apparatus shown in FIG. 8.

In the pasting apparatus of the present invention having the pasting mechanism and the paste layer thickness adjusting mechanism of the above-mentioned construction, furthermore, as shown in FIGS. 8 and 9, base (3) is supported by the supporting leg (1); the wallpaper (6) is fed out from an wallpaper roll (14); and a side-aligning tape for the wallpaper is fed out from a tape roll (16). A paste layer (4) after thickness adjustment is deposited onto the wallpaper (6) thus drawn out. The supporting shafts (17) and (18) for the rolls (14) and (16) may be made detachable, and the supporting leg (1) may be made foldable. Although not shown, it is needless to mention that a counter measuring the length of rolled out wallpaper, for example, may appropriately be attached to the pasting apparatus of the present invention.

Figure 10:
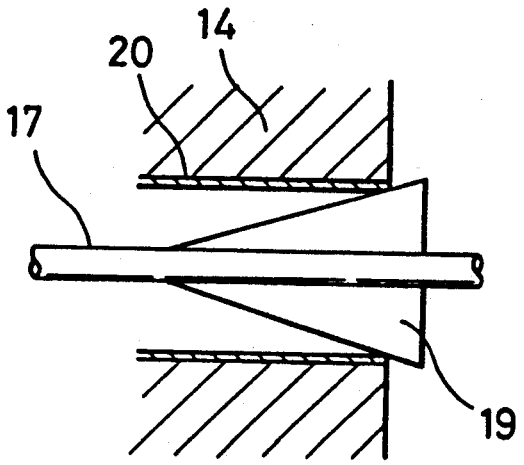
FIG. 10 is an enlarged sectional view illustrating the cone fitting portion.
Figure 11:
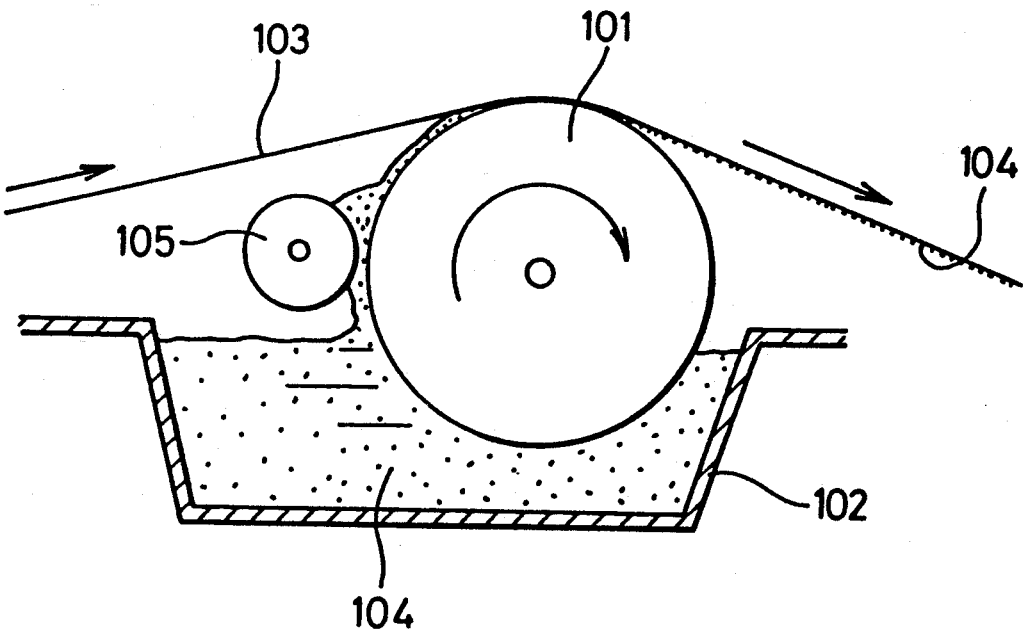
Fig. 11 PRIOR ART
FIG. 11 is a partially cutaway sectional view illustrating an example of the conventional pasting apparatus.

In the wallpaper pasting apparatus of the present invention, as shown in FIG. 9, it is a special feature that cannot be seen in any conventional one that a cone (19) is attached to an end of the supporting shaft (17) as the center core of the wallpaper roll (14). In the conventional apparatus, the drawing tension of the wallpaper differed in the weight of the wallpaper roll (14), leading to an inevitable variation to some extent of the amount of applied paste. This cone (19) is effective for eliminating this defect. As shown in FIG. 10, this cone (19) is attached to an end of the supporting shaft (17) to minimize the gap between the paper pipe (20) of the wallpaper roll (14) and the supporting shaft (17) so that the wallpaper may be drawn out with a uniform tension without causing a deviation under the effect of the difference in tension as in a conventional apparatus.

The present invention is not of course limited to the embodiments presented above. Various varieties in detail or in the construction as a whole are possible.

According to the present invention, as described above in detail, a simple, light and inexpensive pasting apparatus is achieved without using a complicated construction such as a gear mechanism, and this pasting apparatus permits simple and accurate adjustment of the paste layer thickness.

What is claimed is:

1. A wallpaper pasting apparatus, comprising:

a pressing guide means for pressing wallpaper against the upper surface of a pasting roller;

a bar-shaped member provided with a plurality of levelling plates having differing dimensioned wavy edge grooves for the adjustment of the thickness of a paste layer transferred onto the wallpaper depending on which plate is brought into contact with the wallpaper;

a first engagement means provided on a base of the pasting apparatus relative to the levelling plates, and a second engagement means provided in a portion of the apparatus supporting the pressing guide means, said first and second engagement means being adjustably engaged to one another so that the thickness of the paste layer is controlled by selecting a position for engagement of the first and second engagement means and thereby adjusting a pressing force of the wallpaper against one of the levelling plates.

2. A wallpaper pasting apparatus as claimed in claim (1), wherein: said pressing guide means has pressing members provided on both a front portion and a rear portion of the pasting roller.

3. A wallpaper pasting apparatus as claimed in claim (1), wherein: one of said pressing members is provided on front side of the levelling plates and a drawing guide is provided on a rear side of the levelling plates.

4. A wallpaper pasting apparatus as claimed in claim (1), wherein: said portion of the apparatus supporting the pressing guide means is a cover of the pasting apparatus.

5. A wallpaper pasting apparatus as claimed in claim (1), wherein: a cone supports an end of a core of a wallpaper roll.

6. A wallpaper pasting apparatus as claimed in claim (1), wherein: said first engagement means comprises a pressure adjustment pin and said second adjustment means comprises a plurality of pin grooves provided in said portion of the apparatus supporting the pressing guide means.

7. A wallpaper pasting apparatus as claimed in claim 2, wherein: each of said pressing members is a curved plate member.

8. A wallpaper pasting apparatus as claimed in claim (1), wherein: said bar shaped member is rotatable so as to bring a selected levelling plate into contact with the wallpaper.

9. A wallpaper pasting apparatus as claimed in claim 8, wherein: the levelling plates are formed together in a polygon with a levelling plate on at least two sides of said polygon.

10. A wallpaper pasting apparatus as claimed in claim 9, wherein: said polygon is a triangle and a levelling plate is provided on each side of said triangle.

11. A wallpaper pasting apparatus as claimed in claim 9, wherein: said polygon is a rectangle and a levelling plate is provided on each side of said rectangle.

* * * * *